United States Patent [19]

Gray

[11] Patent Number: 4,642,982

[45] Date of Patent: Feb. 17, 1987

[54] CHAIN BELT AND METHOD OF MANUFACTURE

[76] Inventor: Danny J. Gray, 101 N. Summit, Red Oak, Tex. 75154

[21] Appl. No.: 758,968

[22] Filed: Jul. 25, 1985

[51] Int. Cl.[4] ..... B21L 3/00

[52] U.S. Cl. ..... 59/35.1; 59/27; 59/83; 63/9; 2/338; 269/88

[58] Field of Search ..... 63/7, 9, 4; 59/25, 27, 59/35.1, 80, 83, 34, 3, 7, 11, 12, 13, 10; 29/505, 160.6; 140/88; 2/338; 72/302, 392, 378; 228/192; 269/88, 271, 279, 280

[56] References Cited

U.S. PATENT DOCUMENTS

| | | | |
|---|---|---|---|
| 189,986 | 4/1877 | Armstrong | 59/80 |
| 361,857 | 4/1887 | Bigney | 59/35.1 |
| 1,821,058 | 9/1931 | Hadley | 59/35.1 |
| 1,847,901 | 3/1932 | Roy | 63/4 |
| 1,908,072 | 5/1933 | Spang | 59/10 |
| 1,933,638 | 11/1933 | Schaefer | 72/378 |
| 2,451,397 | 10/1948 | Marquardt . | |
| 3,203,200 | 9/1965 | Inotsume | 63/5 |
| 3,319,310 | 5/1967 | Woehling | 72/392 |

FOREIGN PATENT DOCUMENTS

| | | | |
|---|---|---|---|
| 563903 | 7/1957 | Italy | 59/80 |

*Primary Examiner*—Lowell A. Larson
*Assistant Examiner*—David B. Jones
*Attorney, Agent, or Firm*—Richards, Harris, Medlock & Andrews

[57] ABSTRACT

A chain link belt includes a plurality of tube pairs, each pair comprising two tubes joined along their sides in a substantially parallel relation. A plurality of wires of predetermined lengths are used to join the tubes to form the belt links. The wires are formed in a quadrilateral with the tubes on opposite sides thereof and with the joined ends of the wire links positioned within one of the tubes hidden from view. One of the wires is engaged through one tube of the adjacent tube pairs and another wire is engaged through the other tube pairs for connection of other tube pairs to form the chain link belt.

10 Claims, 11 Drawing Figures

CHAIN BELT AND METHOD OF MANUFACTURE

TECHNICAL FIELD

The present invention relates to high fashion belts of the chain link design and a method for manufacturing such belts.

BACKGROUND ART

Several designs for chain belts have been used in the past. Examples of such designs are found in U.S. Pat. Nos. 189,986 to F. Armstrong; 2,451,397 to C. G. Marquardt; 3,203,200, to Zenichi Inotsume; and Design U.S. Pat. No. 230,540 to H. Gillman.

These designs generally provide for different means of joining segments to form a band or belt structure. For example, the band in the Armstrong patent provides for a plurality of links consisting of alternating tubes and coils connected by weaving a cord through these components. The belt in the Marquardt reference includes a plurality of links which are hinged together using pivot pins.

The patent to Inotsume discloses an expandable strap using two continuous bands connected by tube elements. The coupled bands are covered with a box element to form the inner and outer surface of the expandable structure.

The design patent to Gillman discloses a plurality of plates mounted on a strap to form an ornamental belt.

These designs, illustrative of the prior art, fail to provide an artistic belt providing for high wearability and ease of construction. Thus, the need has existed for some time for a design and method of construction of a high fashion belt providing these features.

DISCLOSURE OF THE INVENTION

The present invention relates to both the structure and method for forming a high fashion belt having a chain link design. In the method of forming the belt, a first tube is placed on a wire of predetermined length. A second tube is also placed on the wire, and the wire is then bent to bring its ends in abutting relation and joined. The wire is then bent to form a quadralateral with the tubes on the opposite sides thereof and with the joined ends of the wire within one of the tubes and thereby hidden from view within the tube.

In a more specific embodiment of the invention, the first and second tubes include a pair of tubes connected at their sidewalls in a parallel relation. The second tube of each pair is adapted to receive a wire to form an adjacent link.

In the method of the invention, the bending of the wire is accomplished by placing the tubes in opposed outwardly facing jaws of an appropriate tool. One of the jaws is moved away from the other to form the link, in some cases, stretching the wire as required. The jaws are contoured to correspond to the curvature of the outside diameter of the tubes. Further, the length of the jaws are substantially equal to the length of the corresponding tube. The ends of the jaws may be chamfered to avoid interference during forming with the wire extending from the tube. This is particularly important where belt links having differing length sides are used.

With respect to the chain link belt formed by the present invention, the belt includes a plurality of tube pairs, each pair comprising two tubes joined along their sides in a substantially parallel relation. A plurality of wires of predetermined lengths are used to join the tubes to form the belt links. The wires are formed in a quadralateral with the tubes on opposite sides thereof and with the joined ends of the wire lengths positioned intermediate of the ends of one of the tubes so that it is hidden from view. One of the wires is engaged through one tube of the adjacent tube pairs and another wire is engaged through the other tube of the tube pairs for connection to other tube pairs to form the chain link belt.

In a preferred embodiment of the invention, the ends of the wire are joined by welding. The weld is of sufficient strength to permit the forming of each belt link, including slight stretching of the wire to provide the proper contour.

BRIEF DESCRIPTION OF THE DRAWINGS

For a more complete understanding of the present invention, and for further details and advantages thereof, reference is now made to the following Detailed Description taken in conjunction with the accompanying drawings, in which.

DETAILED DESCRIPTION

Figure 1:
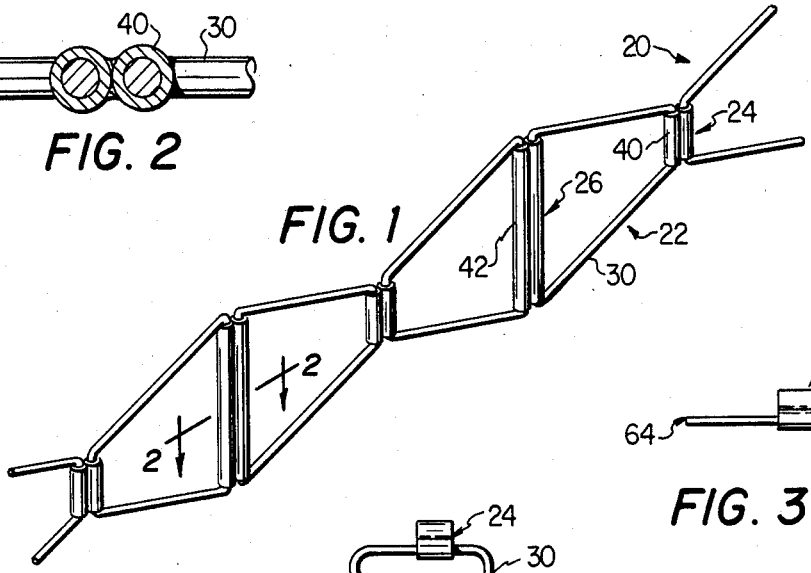
FIG. 1 is a partial perspective view of a chain link belt formed in accordance with the present invention.

Referring to FIG. 1, the belt 20 according to the present invention includes a plurality of links 22 joined by tubular couplers 24 and 26. Links 22 are formed from a predetermined length of wire 30. Although it will be appreciated by those skilled in the art that wire of varying diameters may be used in the practice of the present invention, in the preferred embodiment, wire having a diameter of 1.5 to 2.5 mm is preferred. The wire may be of 24 carat gold, or other material as required to achieve the ultimate design desired.

Figure 2:
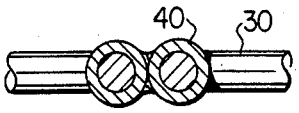
FIG. 2 is a section view taken along lines 2 FIG. 1.

As can be seen in FIGS. 1 and 2, tubular couplers 24 and 26 include a pair of identical tubes 40 and 42, respectively. Tubes 40 and 42 differ only in length and are joined in a parallel relation along their sidewalls by welding or other suitable methods of attachment. The tubes have an inside diameter such that wire 30 may freely move therein with a snug fit.

As can be seen in FIG. 1, each wire link 22 consists of a predetermined length of wire joined at its ends at joint 50. In a preferred embodiment of the invention, this joint is accomplished by welding and is positioned within one of the tubes 40 or 42, that is intermediate of the ends thereof and within the tube such that the joint is hidden from view.

It will be noticed that the belt of the present invention is designed such that a natural hinge is formed using tube couplers 24 and 26. Wire 30 of each link 22 is individually received within one of the tubes of tube couplers 24 and 26 while an adjacent link 22 is received in the attached tube forming tube couplers 24 or 26.

Figure 3:
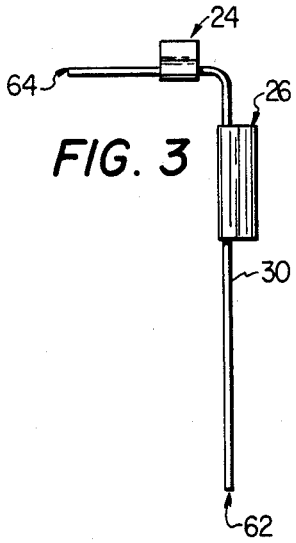
FIGS. 3 through 8 are views showing the steps used in the method of the present invention for forming the chain link belt.
Figure 4:
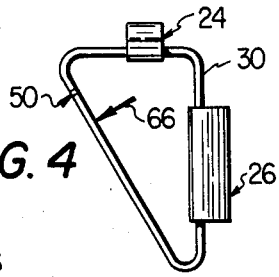

The method of forming the belt according to the present invention is illustrated in FIGS. 3 through 8. Referring to FIG. 3, and according to one embodiment of the invention, link 22 is formed by positioning wire 30 with tube couplers 26 and 24 on wire 30 with a bend 60 in the wire therebetween. Wire 30 is then bent to the position shown in FIG. 4 such that ends 62 and 64 are brought together in an abutting relation. These ends are then joined to form joint 50. In the preferred embodiment of the invention, joining is completed by welding. The weld is completed such that the overall diameter at the point of joint 50 is not appreciably increased.

Figure 5:
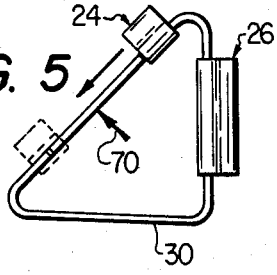

A bending force is then applied to wire 30 at or about the point shown by arrow 66 such that the wire is bent to the approximate position shown in FIG. 5. Tube coupler 24 is then slid on wire 30 such that it covers joint 50. Wire 30 is then bent by applying a force as shown at arrow 70 (FIG. 5) to assume the final position shown in FIG. 6.

Figure 6:
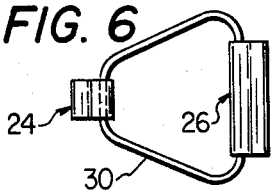
Figure 7:
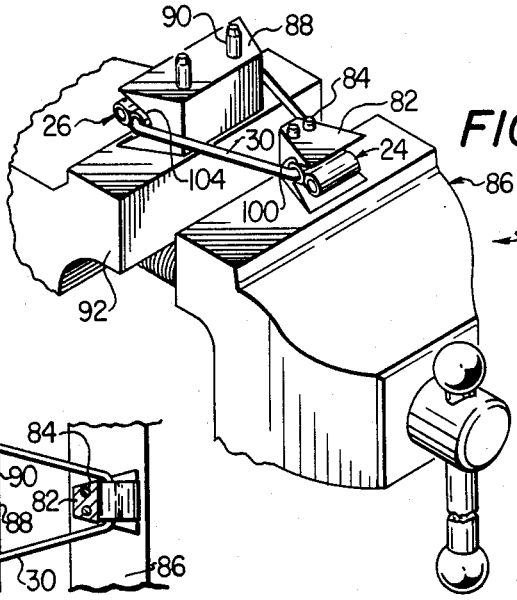
Figure 8:
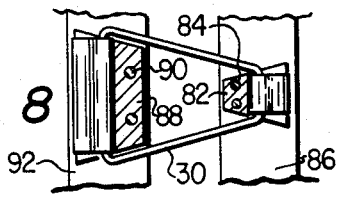

The final forming to the configuration shown in FIG. 6 may be accomplished by using the tool shown in FIG. 7. Referring to FIG. 7, a tool 80 includes a jaw 82 pinned by pins 84 to a movable base 86. A second jaw 88 is also pinned by pins 90 to a fixed base 92. Jaws 82 and 88 have notches 100 and 104, respectively, cut along one face therein with the base of notch 100 having a curvature substantially equal to the outside diameter of tubes 40 and 42 of tube couplers 24 and 26, respectively. In forming the final configuration of the belt of the present invention, tube couplers 24 and 26 are positioned such that tubes 40 and 42 are engaged in notches 100 and 104, and base 86 is moved away from base 92. In this way, jaw 82 moves away from jaw 88 applying a forming and stretching force to form wire 30 to its final configuration. The sides of jaw 82 and 88 are chamfered so that they may be used in conjunction with varying sizes of tube couplers permitting trapazoidal shapes without providing an interference with the position of wire 30. FIGS. 7 and 8 illustrate this feature.

Figure 9:
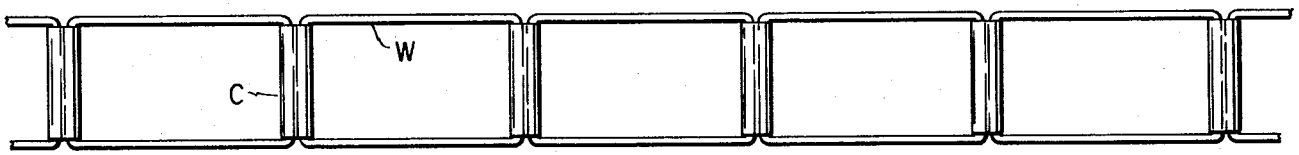
FIGS. 9 through 11 are plan views of alternative designs of belts made in accordance with the present invention.
Figure 10:
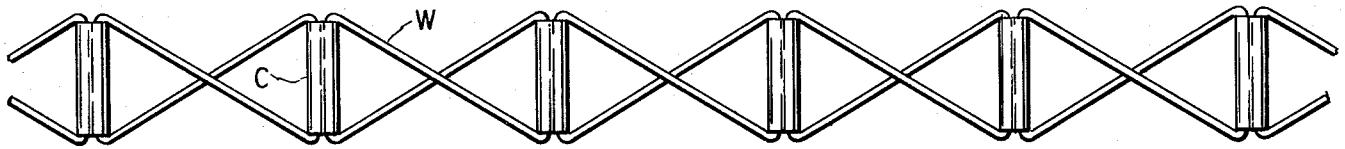
Figure 11:
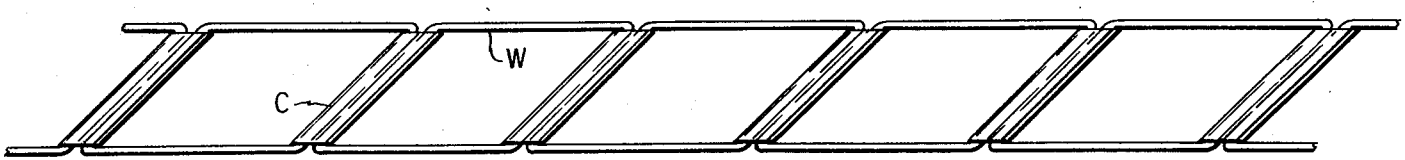

With one link completed, the same process is followed to complete successive links resulting in the chain belt shown in FIG. 1. It will be appreciated by those skilled in the art that varying designs may be used by merely altering the length of wire 30 and the length of tube couplers 24 and 26. Thus, rectangular links may be produced as well as trapazoidal, square, diamond shaped and others. Several alternative final configurations are shown in FIGS. 9 through 11 as examples of designs which can be made. In these designs, the tube couplers are designated by the letter C and the wire by the letter W. The present invention is intended to cover any of these and other designs made in accordance with the present invention.

It will be understood that an appropriate fastener means, such as a bayonet latch, will be provided on the ends of the belt for purposes of attaching the ends. No specific fastening structure is shown as any one of many known designs may be used as desired.

Thus, the present invention produces a chain belt and a method and structure for forming the belt which is unlike any presently shown in the prior art. The present invention permits the production of belts of a high fashion design, provides an extremely sturdy design even though relatively small components are used for purposes of design aesthetics. The final product produces a belt with links which are easily pivotable and with all joints hidden from view within the tube couplers. Further, the method of the present invention provides for the manufacture of the belt of the present invention in a relatively easy manner with few tools. This is accomplished even though a precision belt is achieved.

Although preferred embodiments of the invention have been described in the foregoing Detailed Description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications, and substitutions of parts and elements as fall within the scope of the invention.

I claim:

1. A method of forming a chain link belt comprising:
placing a first tube on a predetermined length of wire having a first and a second end,
placing a second tube on the predetermined length of wire,
initially bending the wire to bring the ends in abutting relation,
joining the ends of said wire, and
finally bending said wire to form a quadrilateral with said tubes on opposite sides thereof and with the joint of the ends of the wire within one of said tubes.

2. The method according to claim 1 further comprising:
joining an additional tube to each of said first and second tubes defining a pair of tubes connected at their side walls in a parallel relation, the additional tube of each pair adapted for receiving a wire to form an adjacent link.

3. The method according to claim 1 wherein said final bending step comprises:
placing the tubes in opposed outwardly facing jaws,
moving one of the jaws away from the other to finally form said link.

4. The method according to claim 3 wherein the step of finally bending said wire comprises contacting said tubes by jaws contoured to correspond to the curvature of the outside diameter of the tubes.

5. The method according to claim 3 wherein the step of finally bending said wire comprises contacting said tubes by said jaws along substantially the entire length thereof.

6. The method according to claim 3 further comprising:
chamfering the ends of the jaws to avoid interference with the wire extending from the tube during forming.

7. A method of forming a chain link belt comprising:
placing a first tube on a predetermined length of wire having a first end and a second end,
bending the wire to form a first and second leg with the first tube on the first leg,
placing a second tube on the second leg of the wire,
bending the wire such that the first and second ends are in an abutting relation,
joining the ends of said wire, and
bending said wire to permit one of the tubes to be positioned over the joined ends of the wire.

8. The method according to claim 7 wherein the wire is finally bent to form a quadrilateral with the tubes on opposite sides and with the joint of the ends of the wire within one of said tubes.

9. The method according to claim 7 wherein the wire is bent substantially in the form of a triangle prior to joining the ends of said wire.

10. The method according to claim 7 further comprising:
joining an additional tube to each of said first and second tubes defining a pair of tubes connected at their sidewalls in a parallel relation, the additional tube of each pair adapted to receive a wire to form an adjacent link.

* * * * *